US006406445B1

(12) United States Patent
Ben-Nun

(10) Patent No.: US 6,406,445 B1
(45) Date of Patent: Jun. 18, 2002

(54) ARTICULATED PNEUMOMASSAGE SLEEVE

(75) Inventor: Asher Ben-Nun, Carmiel (IL)

(73) Assignee: Mego Afek Industrial Measuring Instruments, Doar Afek (IL)

( * ) Notice: Subject to any disclaimer, the term of this patent is extended or adjusted under 35 U.S.C. 154(b) by 24 days.

(21) Appl. No.: 09/715,219

(22) Filed: Nov. 20, 2000

(51) Int. Cl.[7] ..... A61H 9/00
(52) U.S. Cl. ..... 601/152; 601/151; 601/149
(58) Field of Search ..... 601/148, 149, 601/150, 151, 152

(56) References Cited

U.S. PATENT DOCUMENTS 4,338,923 A 7/1982 Gelfer et al.
4,374,518 A 2/1983 Villanueva
5,014,681 A 5/1991 Neeman et al.
5,092,317 A 3/1992 Zelikovski
5,435,009 A 7/1995 Schild et al.

*Primary Examiner*—Michael A. Brown
*Assistant Examiner*—Benjamin K. Koo
(74) *Attorney, Agent, or Firm*—Browdy and Neimark

(57) ABSTRACT

A pneumomassage articulated sleeve adapted to fit onto a foot and lower leg of a patent afflicted with lympbedema or other disorder resulting in excess body fluid. Enveloped by the sleeve is a series of overlapping inflatable cells which when the sleeve is worn, are sequentially inflated to create massaging forces giving rise to a peristaltic action pumping the excess fluid away from the foot and leg. Along the rear of the sleeve is a row of traisverse slots forming articulation joints, each of which is normally fastened. To accommodate the sleeve to the patent to be treated, a slot in the row is unfastened to define a foot section conforming to the foot of the patient and a leg section hinged to the foot section conforming to the lower leg of the patient.

14 Claims, 3 Drawing Sheets

ARTICULATED PNEUMOMASSAGE SLEEVE

FIELD OF THE INVENTION

This invention relates generally to pneumomassage apparatus adapted to displace excess fluid from the body part of a patient and more particularly, to an articulated sleeve for this purpose which fits onto and conforms to the foot and lower leg of the patient.

BACKGROUND OF THE INVENTION

Lymph is a clear fluid which circulates in tissue spaces of the vertebrates and by way of a tubular network passes into the venous system. Lymph is derived from the liquid plasma of the blood but without the red corpuscles. Lymphedema is a disorder that often follows a surgical procedure such as a lymphnode dissection of the groin in the treatment of cancer. It results in an excessive accumulation of lymph in the body tissues which if not reduced may have serious consequences.

To reduce lymphedema or other abnormality giving rise to excess fluid in an afflicted body part, such as an upper or lower limb, it is known to provide an apparatus to compress successively portions of the afflicted part to produce a sequential or peristaltic action pumping excess fluid toward the heart. This apparatus can also be used to improve blood circulation.

U.S. Pat. No. 4,338,923 discloses an inflatable cell-type apparatus for treating edema, the apparatus including a sleeve of flexible material divided into a plurality of internal inflatable cells extending along one dimension of the sleeve, each cell having a port for insetting and outletting air to individually inflate or deflate the cells. The sleeve when applied to the body part to be treated then surrounds it with inflatable cells extending annularly around the sleeve. Means are provided to apply pressurized air to the ports in accordance with a predetermined sequence for inflating and then deflating the cells.

In the pneumomassage apparatus disclosed in U.S. Pat. No. 5,014,681 for applying intermittent compression to a body part, use is made of an inflatable sleeve divided into successively overlapping inflatable cells. Pressurized fluid is applied cyclically to successive groups of cells, so as successively to inflate each group while at the same time partially deflating the preceding group.

A useful feature of the sleeve shown in U.S. Pat. No. 5,014,681 is that the sleeve is formed from a trapezoidal blank, one inclined edge of which is provided with one component of a zipper. Adjacent the opposing inclined edge is a row of spaced complementary zipper components. To fit the sleeve to the limb of a patient, the zipper component on the one edge is connected to a selected complementary component on the opposing edge, thereby creating a sleeve whose dimensions conform to the limb of the patient.

Also of prior art interest is the pneumomassage device disclosed in the U.S. Pat. No. 4,374,518 in which the device is provided with a boot having a series of compartments which conform to the contour of a human foot and leg, the foot part of the boot. A compressor is provided for successively inflating and deflating the compartments of the boot in a rhythmic, preselected cycle.

The inflatable cell-type body treating apparatus disclosed in U.S. Pat. No. 4,338,923 for the treatment of edema includes a flat inflatable band divided into a plurality of internal inflatable cells extending along one dimension of the band, and wrappable about the body part to be treated to form a sleeve with the inflatable cells extending annularly around the sleeve. The inflatable cells are in partially overlapping relationship widthwise of the band.

Inasmuch as a sleeve in accordance with the invention includes overlapping cells inflated and deflated sequentially by a controlled compressor in a manner similar to those of the pneumomassage sleeves disclosed in the above-identified U.S. prior art patents, the disclosures of these patents are incorporated herein by reference.

In order to massage both the foot and lower leg of a patient afflicted with edema, it is known to fit a conical or tubular sleeve on the leg and to fit a separate sleeve on the foot. The advantage of this arrangement is that the patient, as he is being treated, is free to maintain his foot in a natural position and to flex it. This freedom of foot movement promotes the comfort of the patient and is desirable when the treatment is to be carried out for a prolonged period. However, the need for separate foot and leg sleeves and to sequentially inflate the cells in the sleeves introduces unwanted complications.

On the other hand, where the apparatus for treating a patient is in a boot format as in the '518 patent, it can then only be used with those patients whose foot and leg fit into the boot.

SUMMARY OF THE INVENTION

In view of the foregoing, the main object of this invention is to provide an articulated pneumomassage sleeve adapted to fit onto and conform to a foot and lower leg of a patient suffering from an excess of body fluid, the sleeve functioning to displace excess fluid and relieve the patient's condition.

Among the significant advantages of an articulated sleeve in accordance with the invention are the following:

A. The articulated sleeve can be fitted onto the foot and lower leg of patients whose foot and leg dimensions lie within broad ranges. Hence the articulated sleeve functions as a universal pneumomassage appliance.

B. The articulated sleeve can be quickly installed on the foot and leg of a patient or quickly removed therefrom without any difficulty for the patient such as the difficulty experienced when trying to put on a combination of a cylindrical sleeve and a boot.

C. When the articulated sleeve is mounted on the foot and leg of a patient, the foot section is then hinged to the leg section, so that the patient is then free to flex his foot in the course of treatment.

D. The articulated sleeve is relatively inexpensive to manufacture, for incorporated in its structure are standard zippers or other fasteners, and the sleeve is made of bow cost materials.

More particularly, an object of this invention is to provide an articulated sleeve having on its rear side a row of normally-fastened transverse articulation joints, articulation of the sleeve being effected by unfastening a selected joint.

Also an object of this invention is to provide a pair of pants having an upper section that extends to the waist of the patient and a pair of legs below the upper section, each formed by an articulated sleeve enveloping inflatable cells.

Briefly stated, the objects are accomplished by a pneumomassage articulated sleeve adapted to fit onto a foot and lower leg of a patent afflicted with lymphoedema or other disorder resulting in, excess body fluid. Enveloped by the sleeve is a series of overlapping inflatable cells which when the sleeve is worn, are sequentially inflated to create massaging forces giving rise to a sequential or peristaltic massage action pumping the excess fluid away from the foot and leg.

Along the rear of the sleeve is a row of transverse slots forming articulation joints, each of which is normally fastened. To accommodate the sleeve to the patient to be treated a slot in the row is unfastened to define a foot section conforming to the foot of the patient and a leg section hinged to the foot section conforming to the lower leg of the patient.

A sleeve in accordance with the invention can be used for other pneumomassage purposes, as for example, for cosmetic massaging.

BRIEF DESCRIPTION OF THE DRAWINGS

For a better understanding of the invention as well as further features and objects thereof, reference is made to the annexed drawings wherein.

The pneumomassage sleeves illustrated in these figures are by way of example only. In practice articulated sleeves in accordance with the invention may take other forms.

DETAILED DESCRIPTION OF THE INVENTION

Figure 1:
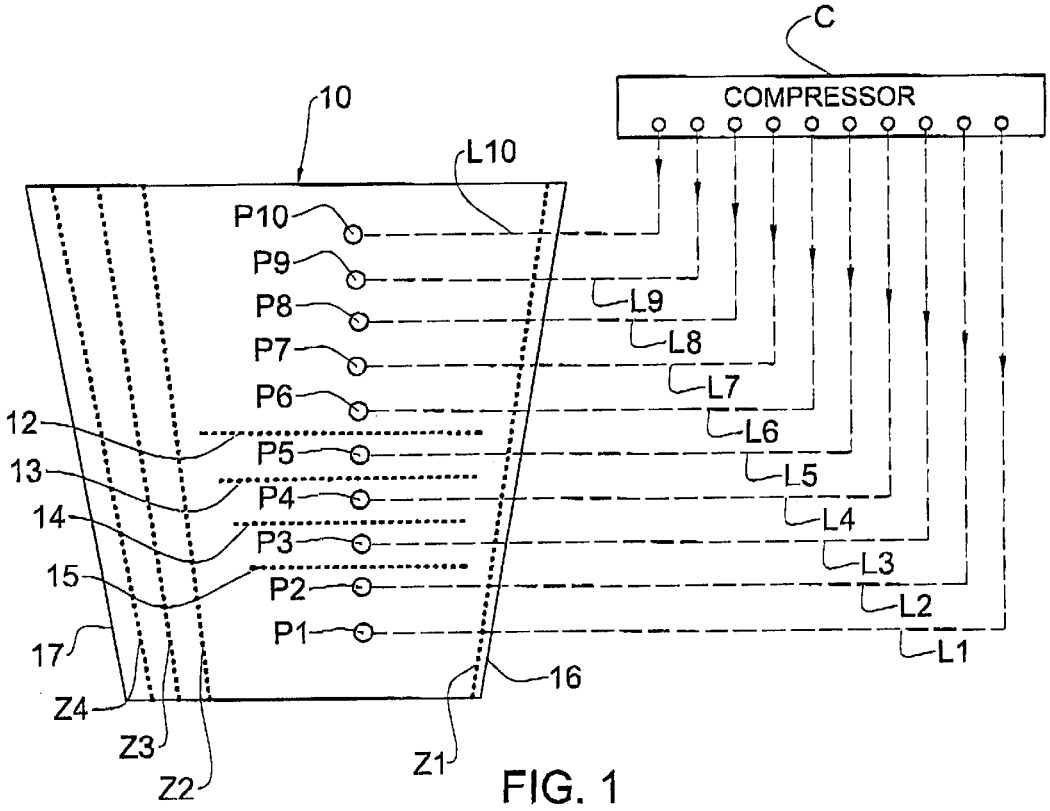
FIG. 1 is illustrates the blank from which a sleeve is formed when the blank is wrapped about the foot and leg of a patient.
Figure 2:
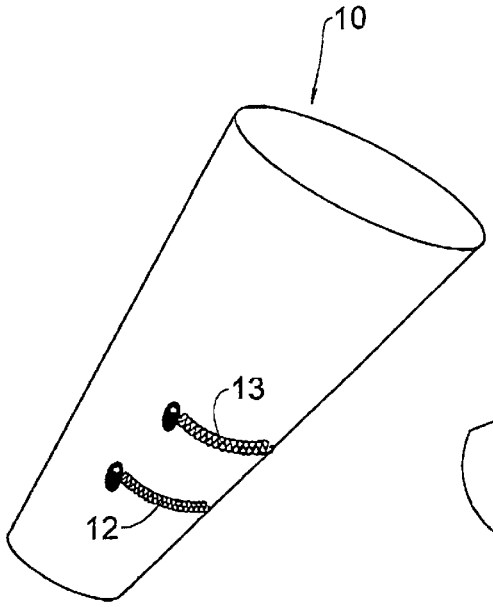
FIG. 2 illustrates schematically the pneumomassage sleeve in accordance with the invention in an unarticulated state.
Figure 3:
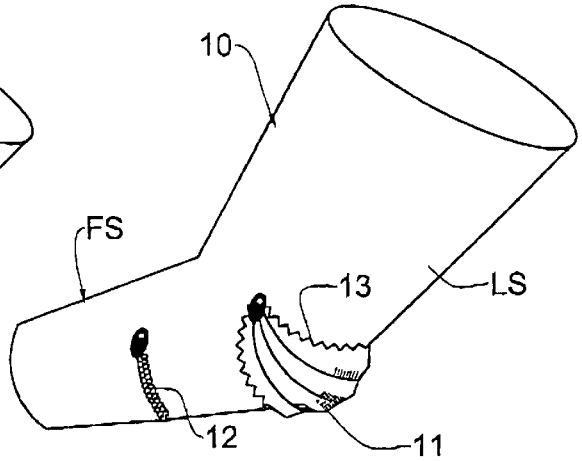
FIG. 3 shows the same sleeve in an articulated state.

Referring now to FIGS. 1, 2 and 3, shown in these figures is a preferred embodiment of an articulated sleeve 10 in accordance with the invention.

FIG. 1 illustrates the trapezoidal blank which when wrapped about the foot and lower leg of the patient to be treated then creates the conical sleeve shown in FIG. 2. FIG. 3 shows the sleeve when articulated to form a foot section. FS surrounding the foot of the patient and a leg section LS hinged thereto surrounding the lower leg of the patient.

Figure 4:
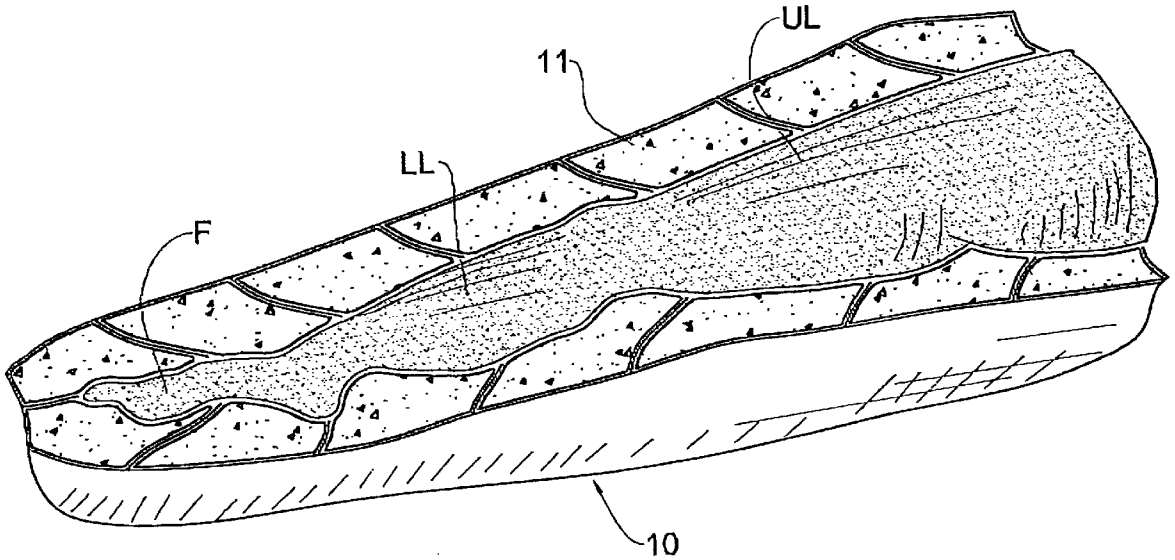
FIG. 4 shows the sleeve in its unarticulated state wrapped about the foot and leg of a patient.
Figure 5:
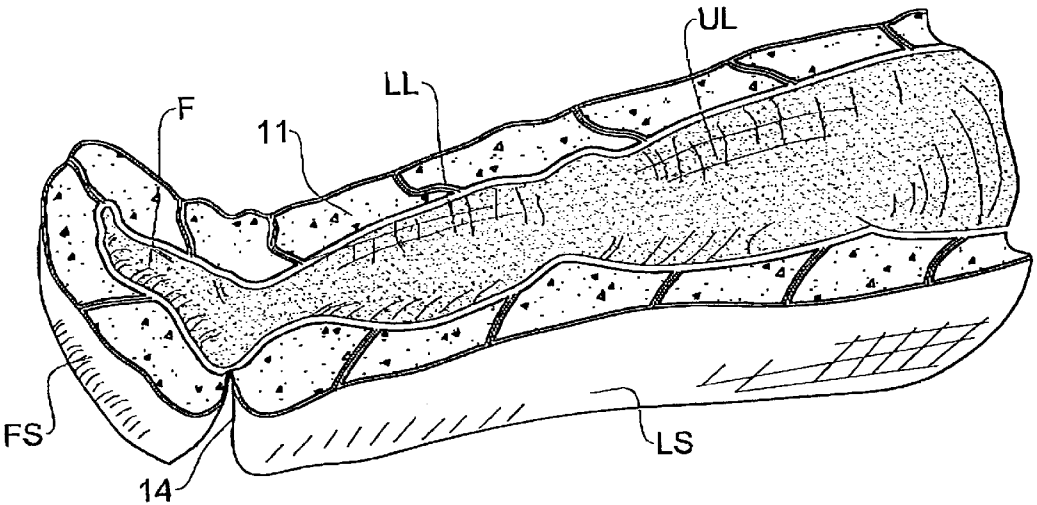
FIG. 5 shows the same sleeve as in FIG. 4, but with one of its articulation joints unfastened to define a foot section hinged to a leg section.

Sleeve 10 which may be fabricated of fabric or plastic sheeting envelops a series of overlapping inflatable cells 11, as shown in FIGS. 4 and 5, formed of an air-impermeable material. Each cell is provided with an inlet-outlet port P1 to P10 (assuming 10 cells). These inflatable cells are coupled through ports P1 to P10 and by tubular lines L1 to L10 to a compressor C which is controlled to sequentially inflate and deflate the cells to produce massaging forces which result in a sequential or peristaltic action pumping excess fluid in the foot and lower leg away therefrom, and in doing so reducing the edema condition.

The means causing the sleeve to function when worn by a patient and the controlled pressurized air system associated with the sleeve are similar to pneumomassaging apparatus disclosed in the above-identified prior patents.

As shown in FIG. 1, blank 10 is provided with a row of equi-spaced transverse slots 12 to 15 forming articulation joints. Each of these slots is normally fastened by a zipper having a slider to open and close the zipper, or by other fastener means such as a VELCRO fastener whose male hook component is attached to one side of the slot and whose female loop component is attached to the opposite side.

When blank 10 is wrapped about the foot and lower leg of a patient to form a sleeve, as shown in FIG. 2, then the articulation joints are located on the rear of the sleeve. In FIGS. 2 and 3, only two articulation joints are shown on the sleeve. In practice however there may be a greater number.

To accommodate the sleeve to the length of the foot and leg of the patient to which the sleeve is applied, the sleeve must be articulated to create a foot section FS hinged to leg section LS. And in order for the length of foot section. FS to substantially match the length of the patient's foot, the slot in the row which is unfastened must articulate the sleeve to form foot and leg sections that are appropriate to the patients' dimensions. Thus FIG. 3 shows that the slot unfastened for this purpose is slot 13, the second slot in the row, thereby exposing at the open joint internal inflatable cells 11.

When accommodating the sleeve to the foot and leg of a patient it is necessary to take into account that these are three-dimensional members, only one dimension of which is length.

To make it possible to convert the trapezoidal blank into a conical sleeve, as shown in FIG. 2 having dimensions appropriate to the patient and conforming to the foot and lower leg of the patient, a selective zipper or other fasteners assembly is provided.

The assembly includes adjacent the inclined right edge 16 of the trapezoidal blank, as shown in FIG. 1, one component Z1 of a standard zipper. Attached adjacent the opposing inclined edge 17 of blank 10 and parallel thereto is an array equi-spaced complementary zipper components Z2, Z3 and Z4, each of which is separately connectable with zipper component Z1 when the zipper slider is operated.

To conform the sleeve to the patient, the blank is wrapped about the foot and lower leg, and the sleeve is then completed by connecting zipper component Z1 to that complementary component (Z2, Z3 or Z4) which produces a snug fit.

Because cells 11 in sleeve 10 are in overlapping relation and sequentially inflated, massaging pressures are advanced along the leg and foot of the patient. And though the unfastened joint creates an articulation break in the sleeve, this break is bridged by the overlapping cells. Hence there is no "dead spot" in the path of the advancing pressures.

In FIG. 4, an elongated sleeve is shown whose length is such that it embraces the foot and the lower leg LL and the upper leg UL of a patient so that the entire limb can be massaged to displace excess fluid therefrom. This sleeve envelops a series of overlapping inflatable cells 11 which when the sleeve is worn are sequentially inflated.

In order to artculate the sleeve shown in FIG. 4 to define a foot section FS hinged to a leg section LS, an articulation joint 14 is unfastened as shown in FIG. 5. This figure shows only a single zipper joint 14. In practice, a row of such joints is provided, as in FIG. 1, so that one can select and unfasten the joint defining a foot and leg section appropriate to the patient wearing the sleeve.

In certain conditions of edema, massaging just the feet and legs may not be sufficient to improve this condition, for it is also necessary to extend the massaging action up to the waist of the patient.

Figure 6:
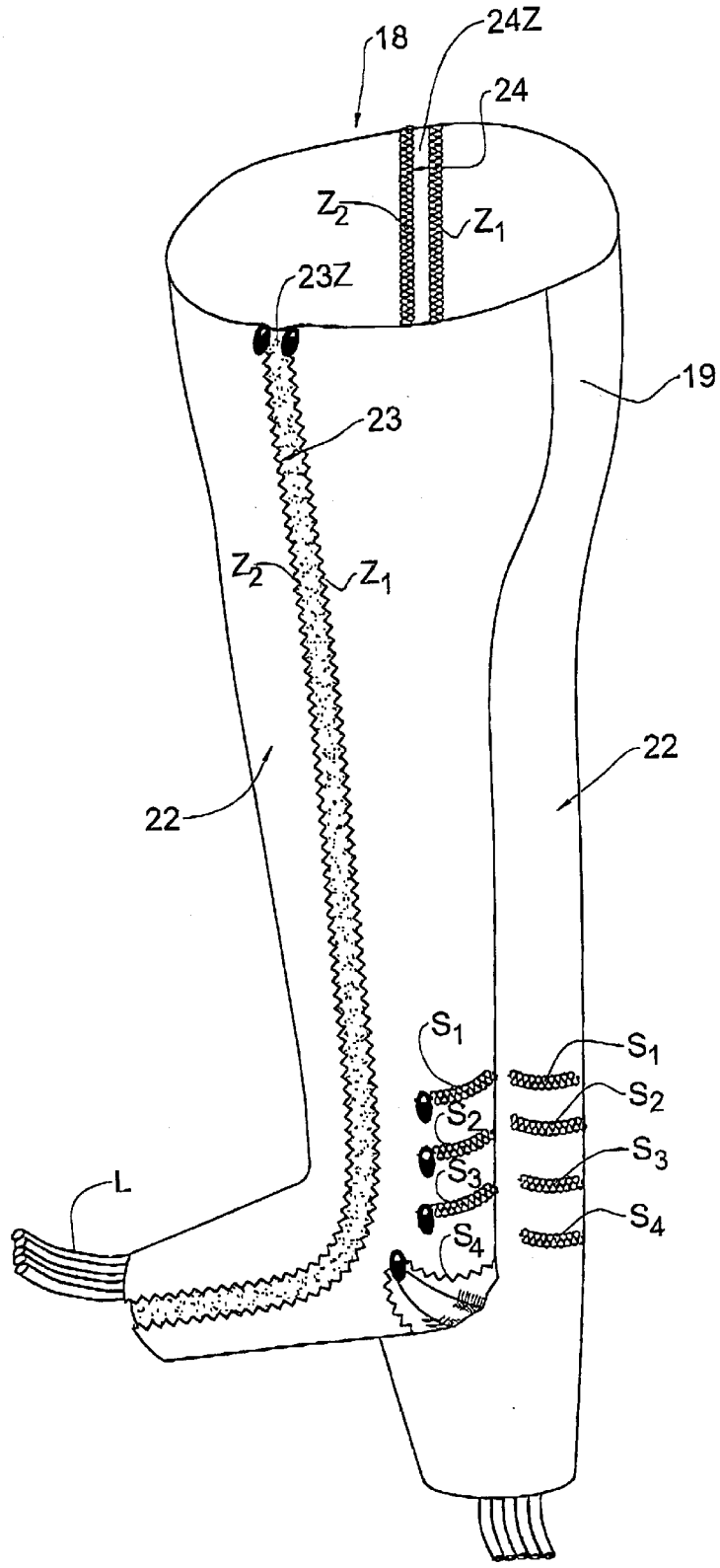
FIG. 6 shows a pair of pants whose legs are formed of articulated pneumomassage sleeves.

This is accomplished by a pair of pneumomassage pants 18, as shown in FIG. 6. These pants include a hip section 19 which extend to the waist of the wearer and goes down to merge with a pair of leg sections, each of which is similar to the multi-cell sleeve shown in FIGS. 4 and 5. Hence the legs of the pants are articulated to fit onto the feet of the wearer and to hinge each foot section to a leg section.

Included in each leg is a row of normally fastened articulation slots S1, S2, S3 and S4. The slot unfastened to articulate the leg is the one which creates a foot section conforming to the foot of the patient wearing the pants. The overlapping inflatable cells incorporated in the structure of the pants are sequentially inflated through a cluster of lines L leading to a controllable compressor, as in FIG. 1.

In order to fit these pants to their wearer, on opposite sides of the pants and extending along the full length thereof are zippers 23 and 24 whose complementary component are affixed to the fabric of the pants at parallel positions to define a bridging zone therebetween. (23Z and 24Z).

The zipper arrangement creates a pants having three waist sizes; large, medium and small. When both zippers 23 and 24 are unfastened, the complementary components of these zippers are spaced apart by bridging zones 23Z and 24Z so that the waist size and leg circumference is then large, being equal to the circular periphery of the pants. When both zippers are fastened, then the zones 23Z and 24Z bulge inwardly to reduce the waist size and leg circumference so that it is relatively small. But when only zipper 23 is fastened to cause zone 23Z to bulge, then the resultant waist size and leg circumference is medium. This pair of pneumomassage pants acts on the entire body below the waist and serves to displace excess fluids therefrom.

While there has been shown preferred embodiments of the invention, it is to be understood that many changes may be made therein without departing from the spirit of the invention.

What is claimed is:

1. A pneumomassage, articulated sleeve adapted to fit onto the foot and leg of an individual to be treated, the sleeve comprising:

A. a blank of flexible material enveloping a series of inflatable cells which when the sleeve is worn are sequentially inflated to create massaging forces giving rise to a sequential or peristaltic action moving from said leg and said foot toward the torso of the individual; and B. a row of traverse slots formed in the blank to create an articulation joint and provided with a fastener which normally locks the joint, whereby when the blank is wrapped about the foot and leg to form a sleeve, the row of joints is then at the rear of the sleeve, the sleeve there being accommodated to the patient by unfastening that joint in the row which defines a foot section that conforms to the foot of the patient and is hinged to a leg section that conforms to the leg of the patient.

2. A sleeve as set forth in claim 1, in which the sleeve is made of fabric sheeting that envelops cells formed of air-impermeable material.

3. A sleeve as set forth in claim 2, in which each cell is provided with a port connectable by a line to a controlled air compressor which operates to inflate the cells in a desired sequence.

4. A sleeve as in claim 1, in which the fastener is a zipper.

5. A sleeve as in claim 4, in which the blank has a trapezoidal form having opposing inclined sides, one fastener component being attached to one side and a row of complementary components being attached to the other side at spaced parallel sites whereby the size of the sleeve created by the blank when wrapped about the foot and leg of the patient depends on which of the complementary components is then connected to the zipper component.

6. A sleeve as set forth in claim 5, in which the fastener is a zipper.

7. A sleeve as set forth in claim 5, in which the fastener is a Velcro fastener.

8. A sleeve as in claim 1, in which the fastener is a Velcro fastener.

9. A sleeve as in claim 1, having a length sufficient to cover both the lower and upper leg of the patient.

10. A pair of pneumomassage pants having a hip section which extends to the waist of the patient and merges with a pair of legs, each leg being constituted by a sleeve as set forth in claim 1.

11. A pair of pants as in claim 10, having a length extending from the foot to the waist of the patient wearing the pants.

12. A pair of pants as in claim 11, including means to adjust the waist and leg circumference size of the pants.

13. A pair of pants as in claim 12, in which the means to adjust the waist and leg circumference size includes a two-component fastener, one component of which is attached to the hip section and a complementary component attached to the hip section at a position parallel to the one component to form a zone therebetween which when the components are fastened together then bulges inwardly to reduce the waist and leg circumference size.

14. A pneumomassage articulated sleeve as set forth in claim 1, in which said individual is a patient afflicted with lymphedema producing excess fluid and the peristaltic action pumps excess fluid away from the foot and leg.

* * * * *